US006398330B1

(12) United States Patent
Chua et al.

(10) Patent No.: US 6,398,330 B1
(45) **Date of Patent: *Jun. 4, 2002**

(54) APPARATUS FOR CONTROLLING PEN-TO-PRINT MEDIUM SPACING

(75) Inventors: Ching Yong Chua; Pui Wen Huang, both of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/477,760

(22) Filed: Jan. 4, 2000

(51) Int. Cl.[7] ..... B41J 25/308
(52) U.S. Cl. ..... 347/8; 400/56
(58) Field of Search ..... 347/8; 400/55, 400/56, 57, 58, 59, 60

(56) References Cited

U.S. PATENT DOCUMENTS 4,883,375 A * 11/1989 Karube et al. ..... 400/55
4,932,797 A * 6/1990 Emenaker et al. ..... 400/56
5,608,430 A * 3/1997 Jones et al. ..... 347/8
5,610,636 A * 3/1997 Hanabusa et al. ..... 347/8

* cited by examiner

*Primary Examiner*—John Barlow
*Assistant Examiner*—Julian D. Huffman

(57) ABSTRACT

An apparatus in a printer for adjusting pen-to-print medium spacing independently of the size of a print medium is disclosed. The apparatus includes a pen, a print platen, a datum, an arm and a means for moving the arm. The print platen supports a print medium for printing using the pen. The datum holds the print platen a first predetermined pen-to-print medium spacing away from the pen. The print platen is resiliently biased against the datum and can be moved away from the datum to define a gap therebetween. The arm is moveable into and out of the gap. When the arm is in the gap, the print platen rests against the arm to define a second predetermined pen-to-print medium spacing. A remotely sent parameter allows the apparatus to make the appropriate adjustment.

14 Claims, 4 Drawing Sheets

APPARATUS FOR CONTROLLING PEN-TO-PRINT MEDIUM SPACING

FIELD OF THE INVENTION

This invention relates generally to the controlling of pen-to-print medium spacing on a wet ink printer. More particularly, the invention concerns an apparatus for adjusting the pen-to-print medium spacing automatically according to a selected thickness of a print medium.

BACKGROUND

Typically an ink-jet printer, or any printer using wet ink, include a pen (also called a printhead) and a print platen for supporting a print medium for printing with the pen. An area between the pen and the print platen is commonly known as a print zone of the printer. The print platen guides and supports the print medium in the print zone during printing. The printer also includes a print medium feed mechanism for feeding a print medium through the print zone. During printing, ink is placed on the print medium by dropping or ejecting the ink from the pen, or by any other printing method well-known by those skilled in the art. The quality of a printout on the print medium depends on the resolution of the printer. The resolution is defined as the number of drops of ink required to cover a given area. For example, a printer with a 600 dots-per-inch (dpi) resolution is able to print dots of a size of 1/600 of an inch. To achieve higher resolution and thus higher quality printing, it is a constant goal to achieve even smaller dot sizes from the pen. In addition to dot size, it is crucial that the drop be placed accurately on a desired position on the print medium. Inaccuracy in placement will result in a printout that lacks sharpness. Also inaccurate placement of dots will affect the colors of a printout since the colors are obtained by a half-toning process. There are several factors affecting the accuracy of placement of ink drops. These factors include the control of the movement of the pen, the timing of firing pulses applied to the pen and other known factors. One factor affecting placement accuracy is the draft that is created by movement of the pen during printing. To reduce the effect of the draft, a print medium is brought as close to the pen as possible. The distance between the pen and the print platen supporting the print medium is known as the pen-to-print medium spacing or distance. The smaller the pen-to-print medium distance, the less likely printing is affected by the draft. However, there is a limit to this reduction of pen-to-print medium distance. When a print medium is brought too close to the pen, smearing will occur during printing. Ink used in wet ink type printing includes a relatively large amount of water. As the wet ink comes into contact with the print medium, the water in the ink saturate the fibers of the print medium, causing the fibers to expand, which in turn causes the print medium to buckle. Such buckling will cause the print medium to come into contact with the pen during printing. Therefore, some allowance is required to prevent such a buckling print medium from touching the pen. Typically in the production of such printers, the pen-to-print medium distance is calibrated for a commonly used media thickness of for example 0.1 mm. With this media thickness, the printer mechanism is adjusted such that a good quality printout is achieveable. Because of the requirement to support media of different thicknesses, some printers are provided with mechanical levers for a user to manually adjust the pen-to-print medium spacing. Usually two values of pen-to-print medium spacing are provided, one for thinner media and the other for thicker media. One disadvantage of such a system is that the quality of printing is contingent on the user remembering to move the lever to the correct position for a print medium. If the pen-to-print medium spacing is incorrectly set, poor quality printout will result. For example if high pen-to-print medium distance is selected for a thin medium, the earlier mentioned problem of draft will affect the accuracy of the placement of the ink drops. If low pen-to-print medium is selected for a thick medium, smearing may occur. It is therefore important that a user sets the lever to the correct position before commencing printing.

To overcome this problem of a user having to properly set the pen-to-print medium distance, some printers are designed to detect the widths of a print medium and to adjust the pen-to-print medium spacing accordingly. However, such a design is restrictive in the sense that it accepts only certain print media of the appropriate size and thickness.

From the foregoing, the prior art therefore has a need for an improved method and apparatus for adjusting pen-to-print medium spacing which is less error prone and which is able to accept media of different sizes and thicknesses.

SUMMARY

In accordance with a preferred embodiment of the present invention, an apparatus for adjusting pen-to-print medium spacing in a printer has a pen and a print platen. The print platen supports a print medium for printing using the pen. The apparatus also includes a datum for holding the print platen a first predetermined pen-to-print medium spacing away from the pen. The print platen is resiliently biased against the datum. The print platen can be moved away from the datum to define a gap therebetween. The apparatus further includes an arm which is moveable into and out of the gap. When the arm is in the gap, the print platen rests against the arm to define a second predetermined pen-to-print medium spacing. The arm is preferably moved by a means which is activated independently of the size of a print medium.

Preferably, this arm moving means includes a first member which has a first cam fixed to a second cam. The first cam has a contour on which the arm rides for the arm to be moved into and out of the gap. The second cam has a contour for tilting the print platen away from the platen when the arm is moved. The first member further includes a main gear fixed to either the first or the second cam. This main gear derives its movement from a motor to rotate the cams. The first member also has a locating means for allowing the position of the cams to be determined.

According to the preferred embodiment, this locating means includes two substantially diagonally disposed toothless sections of different lengths on the main gear. To determine the position of the cams, the arm-moving means further includes a rocker arm. This rocker arm has a first portion and a second portion. The first portion and the second section are angularly disposed to each other. Slidably coupled to the rocker arm is a pivot gear. This pivot gear and the rocker arm are pivotably mounted so that the rocker arm tilts when the pivot gear is rotated. Pivotably mounted on the first portion and second portion are a first gear and a second gear respectively. These first and second gears derive their movement from the pivot gear to drive the main gear in a predetermined direction. At any one time, only one of the first and the second gears is allowed to engage the main gear. When one of the toothless sections is rotated to be adjacent to the first gear, the second gear is adjacent to a toothed section of the main gear. With such an arrangement, a longer of the two toothless sections is driven adjacent to the first gear to define an initialized position of the cams. This position of the cam corresponds to one of the pen-to-print medium spacings. From this known position, the cams can be rotated to alternate between positions corresponding to the first and the second pen-to-print medium spacings.

The rocker arm has a latching means for activating and deactivating the apparatus. During a printing mode, the rocker arm is latched to deactivate it. During an adjustment mode, the latching means releases the rocker arm to allow the rocker arm to be used for adjusting the pen-to-print medium spacing. Such an apparatus allows its movement to be derived from a motor which is used in the printer for advancing a print medium during printing.

The apparatus also allows the pen-to-print medium spacing to be adjusted independently of the size of a print medium. In order for the printer to carry out an adjustment, a parameter indicating the desired pen-to-print medium spacing is remotely sent to the printer.

BRIEF DESCRIPTION OF DRAWINGS

The invention will be better understood with reference to the following drawings, in which:

FIG. 3A however shows the print platen tilted to a position away from the pen to define a second predetermined pen-to-print medium spacing. The wedge arm is moved in between the datum and the lever for the lever to rest against.

FIG. 6 shows the main gear of FIG. 5 rotated in the anti-clockwise direction to a position to allow engagement of teeth by an upper gear on the rocker arm.

FIG. 8 shows the main gear and cams rotated in the anti-clockwise direction to reach a position for providing the second pen-to-print medium spacing.

DETAILED DESCRIPTION OF THE PREFERRED EMBODIMENT

Hereafter, a preferred embodiment of the present invention will be described in the context of an ink jet printer. However, it is to be understood that the invention is usable with any imprinting equipment using a pen or other devices where a pen-to-print medium spacing needs to be adjustable depending on the thickness of a print medium.

Figure 1:
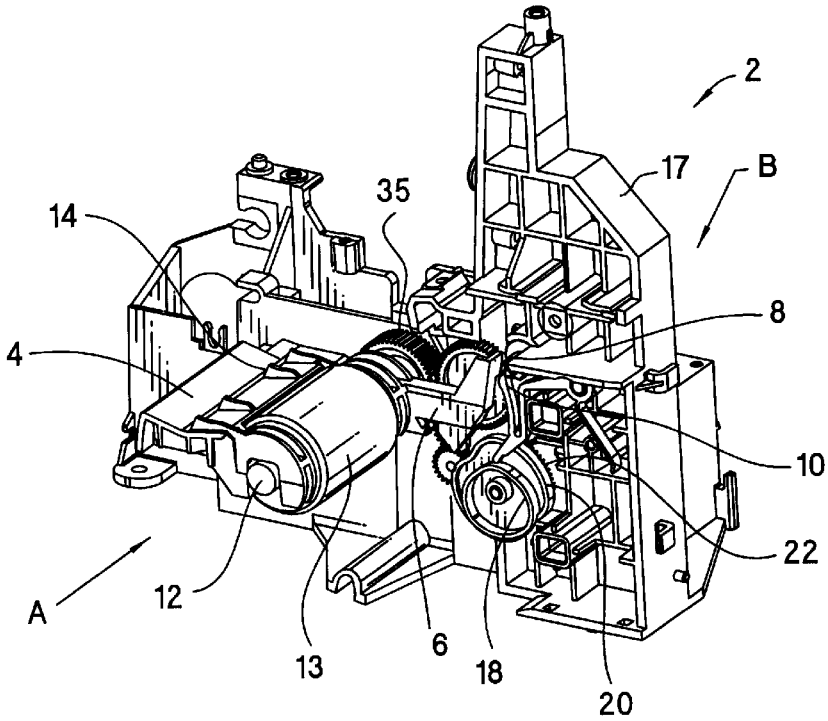
FIG. 1 is an isometric view of a portion of the ink jet printer showing a print platen with an attached lever, a datum, a wedge arm and means for moving the wedge arm for changing the pen-to-print medium spacing of the printer, according to a preferred embodiment of the present invention. The print platen is pivotably attached to a drive roller for tilting to c

FIG. 1 is an isometric view of a portion of the ink jet printer 2 showing a print platen 4 with an attached lever 6, a datum 8 and a wedge arm 10 for changing the pen-to-print medium spacing of the printer 2. The print platen 4 is pivotably mounted on a drive roller shaft 12. The print platen 4 is also resiliently biased by a tensioned spring (not shown) for pulling the lever 6 to rest against the datum 8. Rollers 13 mounted on the drive roller shaft 12 transport a print medium to a print zone of the printer 2 for printing. Ribs 14 on the print platen 4 maintain a wet print medium, which has a tendency to warp, to be substantially flat. Such flattening of a print medium allows the pen-to-print medium distance to be more easily controlled as compared to a warped print medium.

Figure 2B:
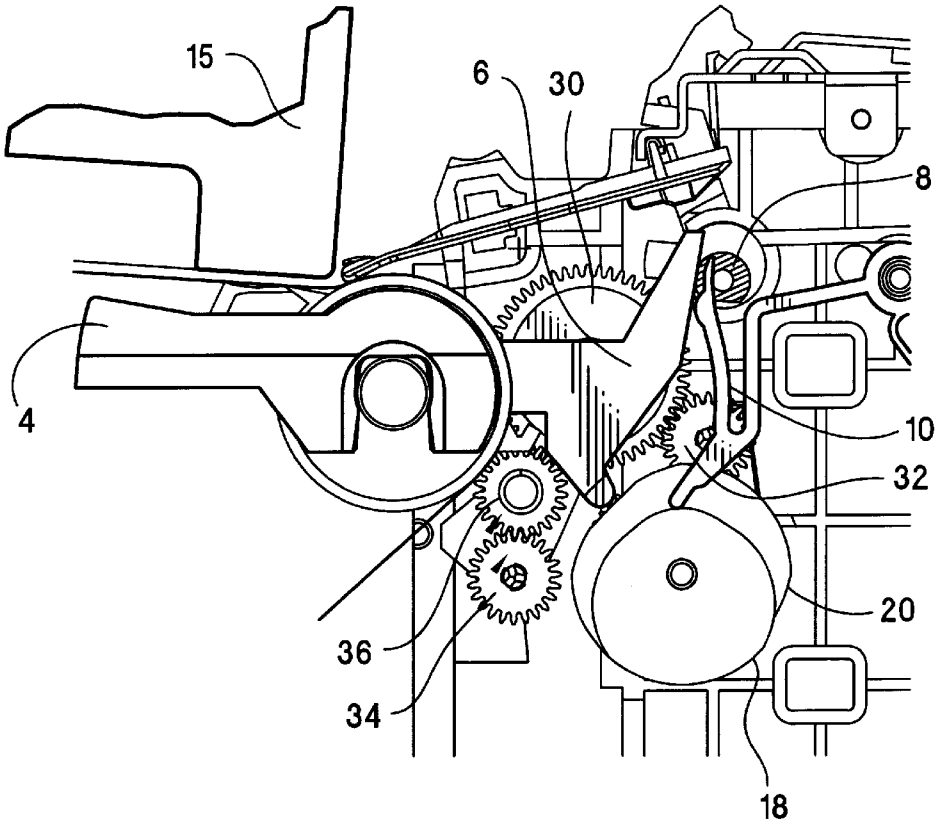
FIG. 2B is a similar figure to FIG. 2A in which a portion of FIG. 2A is enlarged to give a clearer view of the positions of the lever, the wedge arm and the means for moving the wedge arm for defining the first pen-to-print medium spacing.
Figure 2A:
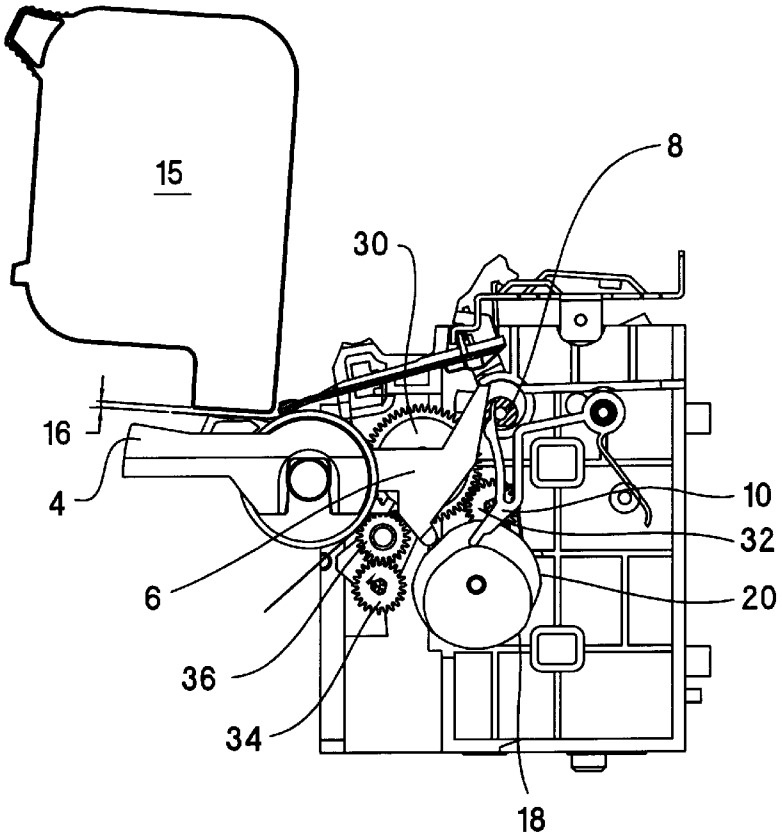
FIG. 2A is a side view of the portion of the ink jet printer in FIG. 1 taken in the direction of an arrow A in FIG. 1. The figure shows the wedge arm moved to a lowered position in which the wedge arm does not directly affect the pen-to-print medium spacing. The lever rests against the datum to define a first pen-to-print medium spacing.

FIG. 2A is a side view of the portion of the printer 2 in the direction of an arrow A in FIG. 1. The figure shows a pen 15 which is fixed in its vertical position. The print platen 4 when resting against the datum 8 is held in a spatial relationship to the pen 15 to define a first pen-to-print medium spacing 16. The pen-to-print medium spacing can be adjusted by tilting the print platen 4 about its pivoting axis. The datum 8 is fixed on a support wall 17 of the printer 2. FIG. 2A shows the wedge arm 10 moved to a lowered position in which the wedge arm 10 does not directly affect the pen-to-print medium spacing 16. FIG. 2B is a similar figure to FIG. 2A in which a portion of FIG. 2A is enlarged to show a clearer view of the positions of the lever 6 and the wedge arm 10 in relation to the datum 8 for defining the first pen-to-print medium spacing 16.

Figure 3B:
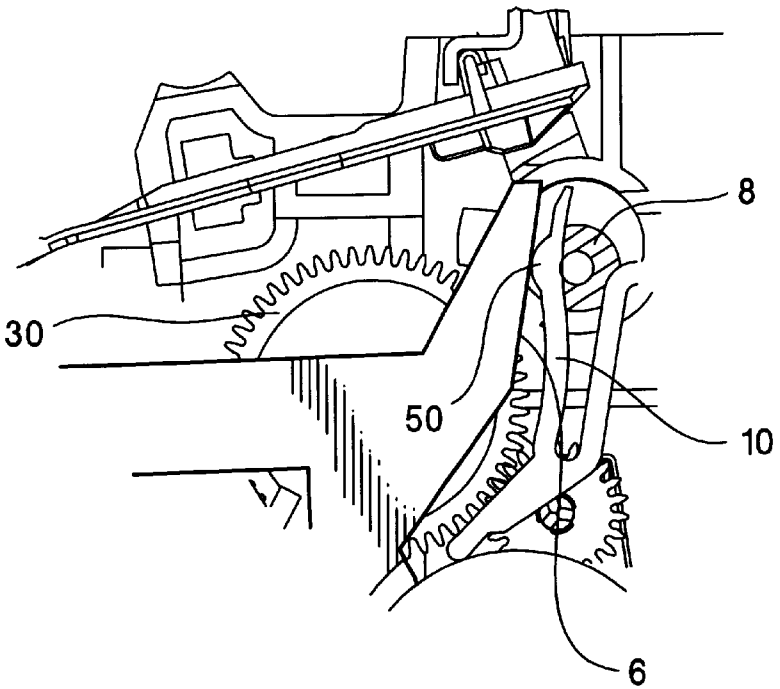
FIG. 3B is an enlarged view of a portion of FIG. 3A. In particular, this figure shows the lever resting against a portion of the wedge arm.
Figure 3A:
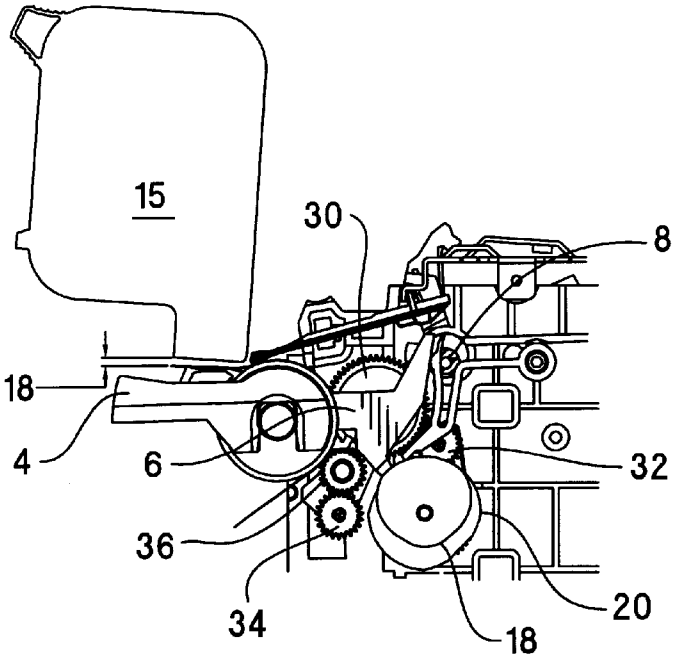
FIG. 3A is a side view similar to FIG. 2A and FIG. 2B.

FIG. 3A is a side view similar to FIG. 2A and FIG. 2B. FIG. 3A however shows the print platen 4 tilted to a position away from the pen 15 to define a second predetermined pen-to-print medium spacing 18. To adjust the pen-to-print medium spacing to this second predetermined value, the wedge arm 10 is moved to a raised position to be between the lever 6 of the print platen 4 and the datum 8. The print platen 4 rests against the wedge arm 10 instead of the datum 8. FIG. 3B is a side view showing an enlarged portion of FIG. 3A.

Figure 4:
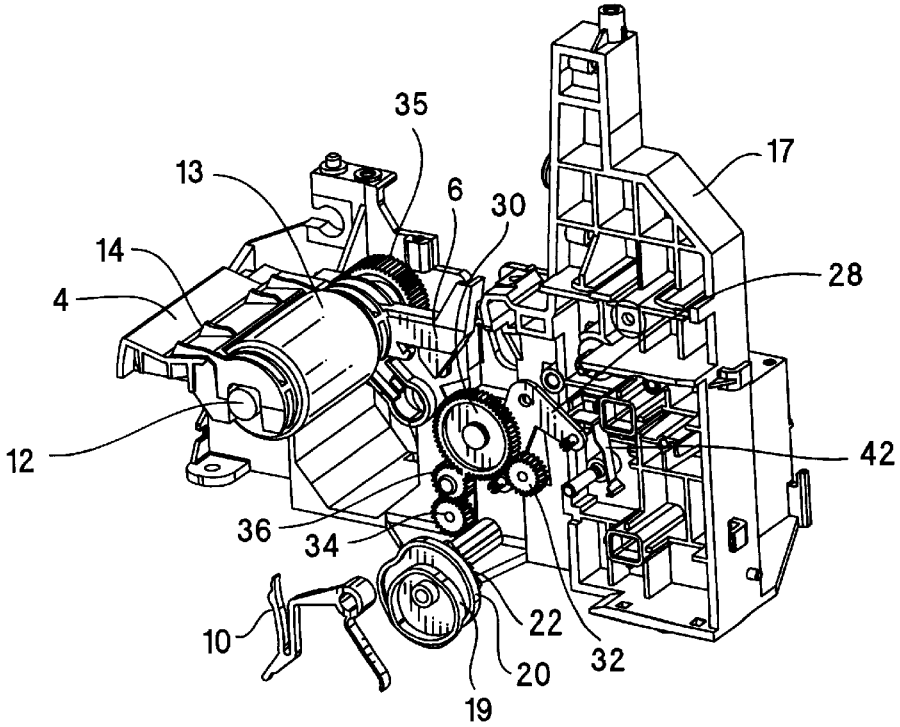
FIG. 4 is an exploded isometric view of the portion of the printer in FIG. 1. The means for moving the arm in FIG. 1 includes two cams, a main gear (most of which is hidden behind the cams), a rocker arm and associated gears and a drive gear.

FIG. 4 is an exploded isometric view of the portion of the printer 2 in FIG. 1. This portion of the printer includes apparatus according to the present invention for adjusting the pen-to-print medium spacing. The apparatus has two concentric cams fixedly mounted to each other, a smaller cam 19 for moving the wedge arm 10 and a larger cam 20 for tilting the print platen 4. The cams 19, 20 are preferably integrally molded. The cams 19, 20 have cooperating contours. When the cams are rotated, the contour on the smaller cam 19 moves the wedge arm 10 up and down while the contour on the larger cam 20 tilts the lever 6 of the print platen 4. Coupled to these cams 19, 20 is a main gear 22.

Laterally extending from this main gear 22 are two profiled ribs 24, 26. Each profiled rib has two seats. Also included in the apparatus is a rocker arm 28 with gears pivotably attached for rotating the main gear 22. The rocker arm is pivotably mounted to the support wall 17. A pivot gear 30 on the rocker arm 10 shares the same pivoting axis as the rocker arm 28 and is slidably coupled to the rocker arm 28. The friction in this coupling allows the rocker arm 28 to tilt with the pivot gear 30 when the pivot gear 30 is rotated. However when the rocker arm 28 is impeded in its movement, the pivot gear 30 rotates independently of the rocker arm 28. This pivot gear 30 interacts with an upper gear 32 and a lower gear 34 on the rocker arm 28 to drive the gears to rotate the main gear. At any time, only one of the upper gear 32 and the lower gear 34 is allowed to come into contact with the main gear 22 to rotate the main gear 22. When one gear is in contact with the main gear 22, the other is tilted away from the main gear 22. The pivot gear 30 draws its movement from a drive gear 35 fixed on the drive roller shaft 12. In meshing configuration with the pivot gear 30 is a spring-loaded gear 36. This spring-loaded gear 36 is pivoted to the rocker arm away from the axis of rotation of the rocker arm 28 to allow the rocker arm 28 to tilt easily when the pivot gear 30 is rotated. The spring-loaded gear 36 is pivoted to the rocker arm 28 together with a compressed wave washer (not shown) to increase the torque required to rotate the spring-loaded gear 36.

Figure 5:
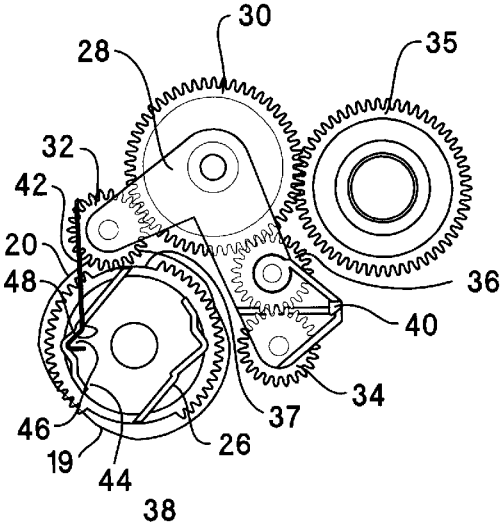
FIG. 5 is a side view of the main gear, the two cams, the rocker arm and the drive gear in FIG. 4 as seen in a direction according to an arrow B in FIG. 1. The figure shows the main gear and the cams in a home position to provide the first pen-to-print medium spacing.

FIG. 5 is a side view of the main gear 22, cams 19, 20, rocker arm 28 and drive gear 35 as seen in a direction according to an arrow B in FIG. 1. The figure shows the main gear 22 and the cams 19, 20 in a home position. As power to the printer 2 may be turned off at any time to leave the main gear 22 in an unknown position, it is important for the printer 2 to initialize the main gear 22 to a known position on powering up. In this preferred embodiment, the main gear is moved to the known home position as shown in FIG. 5. The initialization sequence is now described. Regardless of which direction the drive gear 35 is driven, the rocker arm 28 will ensure that the main gear 22 is driven only in one direction. When viewed in the direction of arrow B in FIG. 1, the main gear 22 is driven in an anti-clockwise direction. When the pivot gear 30 is rotated in a clockwise direction, the rocker arm 28 will tilt in the same direction. The lower gear 34 will mesh with the main gear 22 to rotate the main gear 22 in the anti-clockwise direction. Hereafter, the direction of rotation of the gears will be described with reference to drawings having a similar perspective to FIG. 5.

The main gear 22 has two diagonally disposed toothless sections 37, 38 of different lengths. These toothless sections 37, 38 allow the printer to ascertain the position of the main gear 22. The main gear 22 is driven until the longer of the two toothless sections 37, 38 is facing upwards to be adjacent to the upper gear 32. To get the main gear 22 to this position from some unknown position, a predetermined sequence of driving the drive gear 35 is performed. In a first step of the sequence, the drive gear 35 is driven in a clockwise direction to allow the rocker arm 28 to be tilted in an anti-clockwise direction. In this position of the rocker arm 28, the upper gear 32 impinges on the main gear 22 to attempt to rotate the main gear 22. If there is meshing of teeth on the two gears, the main gear 22 will rotate in the anti-clockwise direction in synchronization with the upper gear 32. The main gear 22 is rotated sufficiently to bring one of the two toothless sections 37, 38 adjacent to the upper gear 32. If one of the two toothless sections 37, 38 is already adjacent to the upper gear 32 prior to this first step, the rotation of the upper gear 32 will not affect the position of the main gear 22.

In a second step of the sequence, the drive gear 35 is driven in an anti-clockwise direction while a latch 40 on the rocker arm 28 is released. This latch 40 allows the rocker arm 28 to be released to adjust the pen-to-print medium spacing only when desired. The release of the rocker arm 28 allows the rocker arm 28 to tilt in a clockwise direction. With the upper gear 32 above a toothless section, the lower gear 34 on the rocker arm 28 engages a toothed portion of the main gear 22 approximately a quadrant away from the toothless section. The lower gear 34 continues to rotate the main gear 22 in the anti-clockwise direction by a first predetermined angular distance. This first predetermined angular distance is longer than the shorter toothless section 38 and shorter than the longer toothless section 37. If prior to this second step the upper gear 32 is adjacent to the longer toothless section 37, the rotation of the main gear for the first predetermined angular distance will not permanently advance the main gear 22. A first profiled rib 24 on the main gear will interact with a cantilever spring 42 fixed at one end to the support wall 17 to index the main gear 22 back into its position prior to the rotation for the first predetermined angular distance. As the lower gear 34 rotates the main gear 22, the cantilever spring 42 flexes under the pressure caused by the profiled rib 24. The free end of the cantilever spring 42 will slide along a first portion 44 of the profiled rib 24 to flex the cantilever spring 42. In a subsequent third step, as the drive gear 35 is driven in the clockwise direction once again, the flexed cantilever spring 24 will tend to return to its straightened position. With the main gear 22 unimpeded during this switchover of direction of rotation, the cantilever spring 42 will interact with the first portion 44 of the profiled rib 24 to rotate the main gear 22 in the clockwise direction. The main gear will stop rotating in this clockwise direction when the free end of the cantilever spring 42 locates a first seat 46 on the profiled rib 24. Effectively, the main gear 22 is not moved in the second step if the longer toothless portion 37 is already adjacent to the upper gear 32 prior to the second step.

However, if prior to the second step the shorter toothless section 38 is adjacent to the upper gear 32, the advancement of the main gear 22 by the first predetermined angular distance will cause teeth on the main gear 22 to mesh with those on the upper gear 32 during the switchover. This meshing of teeth ensures that when the upper gear 32 is rotated in the third step, it advances the main gear 22 sufficiently to bring the longer toothless section 37 adjacent to the upper gear 32. In this position, the main gear 22 is in its home position and the smaller cam 19 is downward facing. The wedge arm 10 is pivoted to the support wall 17 and is biased to follow the contour of the smaller cam 18. In the downward position of the smaller cam 18, the wedge arm 10 is lowered for setting the pen-to-print medium spacing to its first predetermined value. The lever 6 of the print platen 4 also follows the contour of the larger cam 20. In this position of the main gear 22, cams 19, 20, and wedge arm 10; the tensioned spring (not shown) pulls the lever 6 on the print platen 4 against the datum 8 as shown in FIGS. 2A and 2B. The datum 8 can be cam-shaped and made tiltable to allow easy adjustment of the pen-to-print medium spacing to a desired value.

Figure 6:
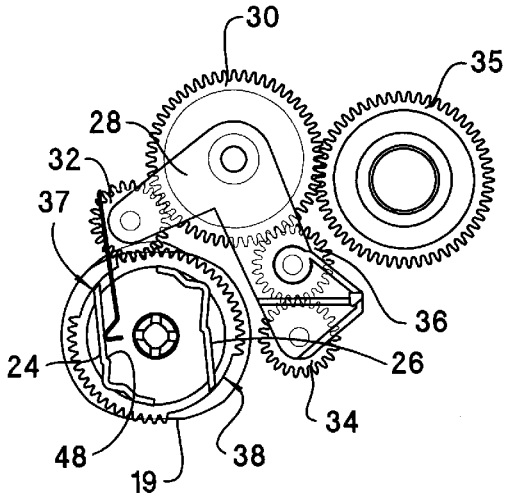
FIG. 6 is a side view similar to FIG. 5.

Next, the drive sequence required to change the pen-to-print medium spacing to the second predetermined value is described. The latch 40 on the rocker arm 28 is again released to allow the rotation of the drive gear 35 to tilt the rocker arm 28 in a clockwise direction. The lower gear on the rocker arm will once again drive the main gear 22 in the anti-clockwise direction. Since it is known that the longer toothless section 37 is adjacent the upper gear 32, the main gear 22 is driven for a second predetermined angular distance required to bring teeth on the main gear 22 adjacent the upper gear 32. This second predetermined angular distance is longer than the longer toothless section 37. When driven for this distance, the free end of the cantilever spring 42 will press against a second seat 48 on the profiled rib 24 to prevent the main gear 22 from reverting to its home position. FIG. 6 shows the main gear 22 driven to a position to allow engagement of teeth by the upper gear 32. This step is similar to the second step in the initialization sequence except for the angular distance covered by the main gear 22.

Figure 7:
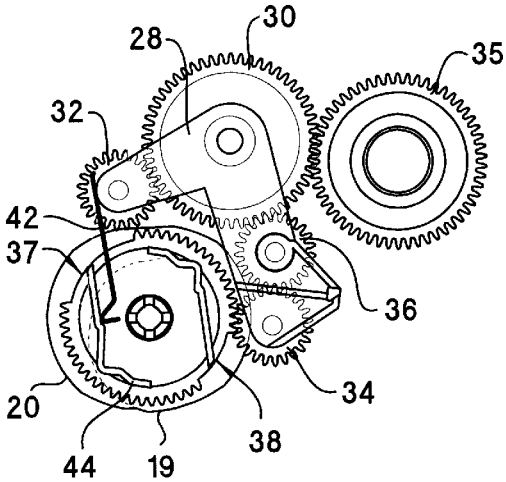
FIG. 7 is another side view similar to FIG. 5. The figure shows the meshing of teeth on the main gear and the upper gear for allowing the upper gear to rotate the main gear in the anti-clockwise direction.
Figure 8:
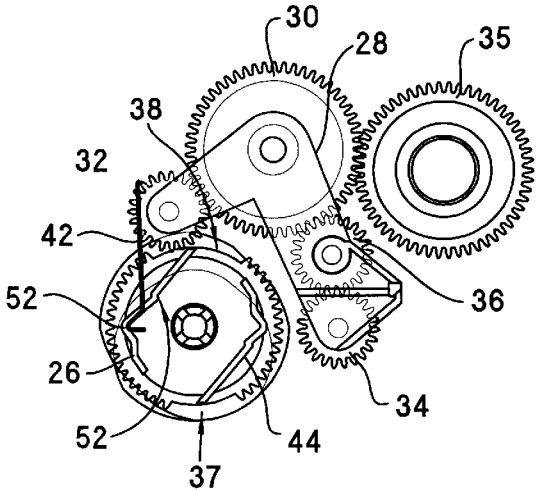
FIG. 8 is yet another side view similar to FIG. 5.

Next the drive gear 35 is driven in the anti-clockwise direction to tilt the rocker arm 28 in the anti-clockwise direction. This step is similar to the third step in the initialization sequence. Teeth on the upper gear 32 will mesh with teeth on the main gear 22 to rotate the main gear 22 in the anti-clockwise direction. FIG. 7 shows the meshing of teeth on the main gear 22 and the upper gear 32. As the main gear 22 is driven, the print platen 4 follows the contour of the larger cam 20 to tilt away from the datum 8 to define a gap therebetween. The wedge arm 10 also follows the contour of the smaller cam 18 to tilt towards the gap between the print platen 4 and the datum 8. As the main gear 22 is driven further in the anti-clockwise direction, the shorter toothless section 38 will be brought adjacent to the upper gear 32. At this point, the main gear 22 will not rotate further even if the upper gear 32 continues to rotate. A seat 50 on the profiled rib 26 holds the free end of the cantilever spring 42 to maintain the main gear 22 in position. In this position of the main gear 22, the smaller cam 18 pushes the wedge arm 10 to its raised position. The print platen 4 follows the contour of the larger cam 20 to tilt towards the datum 8 under the pulling force of the spring (not shown). With the wedge arm 10 in its way, the print platen 4 is not allowed to return to its earlier position but will come to rest against the wedge arm 10. The dimensions of a portion 50 (FIG. 3B) of the wedge arm which is caught in between the lever 6 and the datum 8 determines the second pen-to-print medium spacing.

A similar sequence of driving the drive gear 35 as described will return the wedge arm 10 to its lowered position to give the first predetermined pen-to-print medium spacing. Although it is possible to drive the main gear 22 for a smaller angular distance than the second predetermined value, the main gear 22 is advanced by the second predetermined value to prime the main gear 22 for rotation by the upper gear 32. A second seat 52 on the second profiled rib 26 ensures that the main gear 22 is properly positioned for meshing with the upper gear 32.

During normal operations of the printer, the upper gear 32 of the rocker arm 28 will be adjacent one of the toothless sections of the main gear. So long as the rocker arm is latched and not allowed to prime the main gear 22, the main gear 22 will not be rotated by rotation of the drive gear 35. In this preferred embodiment, the printer uses only one single motor to perform the printer's operation such as picking and feeding of a print medium and for adjusting the pen-to-print medium spacing. To pick a print medium, a pen carriage is driven to engage and tilt a second rocker arm (not shown) to activate a pick roller (not shown). This activation of the second rocker arm releases the latch 40 on the first rocker arm 28 and allows it to be used for adjusting the pen-to-print medium spacing. It is important to ensure that the sequence of driving the pick roller does not interfere with the sequence of driving the rocker arm for changing the pen-to-print medium spacing.

With the above-described apparatus for adjusting the pen-to-print medium spacing on a printer, there is no necessity for any manual adjustment to be made on the printer to change the pen-to-print medium spacing. Also, the adjustment is independent of the size of a print media. A remotely sent parameter relating to the thickness of a selected print medium would suffice for the printer to perform the necessary adjustment. This parameter can be sent to the printer along with other details of a printjob.

We claim:

1. Apparatus for adjusting pen-to-print medium spacing in a printer comprising:

a fixed datum;

a print platen for supporting a print medium for printing by a pen moveable across the print medium, the print platen being resiliently biased towards the datum to come to rest in a first position where the print platen rests directly against the datum to define a first predetermined pen-to-print medium spacing between the pen and the print platen, the print platen being movable away from the datum to define a gap therebetween; and an arm moveable between an unused position away from the gap and an engaged position in the gap for the print platen to alternatively rest against to prevent the print platen returning to the first position to thereby define a second predetermined pen-to-print medium spacing;

wherein the platen and the arm are moved according to a remote medium thickness parameter received by the printer.

2. The apparatus according to claim 1, further including a means for moving the arm between the unused and the engaged positions.

3. The apparatus according to claim 2, wherein the means for moving the arm further includes means for simultaneously moving the print platen towards and away from the datum to facilitate movement of the arm into and out of the gap.

4. The apparatus according to claim 3, further including a latching means for releasably engaging the arm moving means, wherein the latching means engages the arm moving means to disable the arm moving means and releases the arm moving means to allow operation of the arm moving means.

5. The apparatus according to claim 4, wherein the means for moving the arm includes a rotary member which includes:

a first cam having a contour on which the arm rides for the arm to be moved between the unused and the engaged position;

a second cam fixed to the first cam, the second cam having a contour for tilting the print platen;

a main gear fixed to either the first or the second cam for rotating the cams; and a locating means associated with the main gear for allowing the position of the cams corresponding to the unused and engaged positions of the arm to be determined.

6. The apparatus according to claim 5, wherein the locating means includes two substantially diagonally disposed toothless sections of different lengths on the main gear, and wherein the means for moving the arm further includes:

a rocker arm having a first portion and a second portion, the first portion and the second portion being angularly disposed;

a pivot gear slidably coupled to the rocker arm, the rocker arm and pivot gear being pivotably mounted along a common axis so that rotation of the pivot gear will tilt the rocker arm when movement of the rocker arm is not impeded;

a first gear pivotably mounted on the first portion and deriving its movement from the pivot gear for engaging the main gear to rotate the main gear in a predetermined direction;

a second gear pivotably mounted on the second portion and deriving its movement from the pivot gear for engaging the main gear to rotate the main gear in the predetermined direction; wherein:

the angular disposition of the first and second portions allows only one of the first gear and the second gear to engage the main gear at any one time depending on the direction of rotation of the pivot gear;

the toothless sections are disposed such that when one of the toothless sections is rotated to be adjacent the first gear, the second gear is adjacent a toothed section of the main gear; and the latching means is supported by the rocker arm.

7. The apparatus according to claim 6, further including:

a cantilever spring having a free end; and two profiled ribs fixedly attached to the rotary member, each profiled rib corresponding to a toothless section and having two seats, each profiled rib interacting with the cantilever spring to bias the rotary member to positions defined by the location of the free end of the cantilever spring in the seats.

8. Apparatus for adjusting pen-to-print medium spacing in a printer comprising:

a fixed datum;

a print platen for supporting a print medium for printing by a pen moveable across the print medium, the print platen being resiliently biased towards the datum to come to rest directly against the datum to define a first spacing between the pen and the print platen, the print platen being moveable away from the datum to define a gap therebetween;

an arm movable into the gap for the print platen to alternatively rest against to thereby define a second spacing; and two concentric cams that cooperatively drive the print platen and the arm to select either the first or the second spacing.

9. The apparatus according to claim 8, further includes:

a main gear fixed to one of the two cams for simultaneously rotating the two cams; and a locating means associated with the main gear for allowing the position of the cams and the arm to be determined.

10. The apparatus according to claim 9, wherein the locating means includes two substantially diagonally disposed toothless sections of different lengths on the main gear.

11. The apparatus according to claim 10, further including:

a rocker arm having a first portion and a second portion, the first portion and the second portion being angularly disposed;

a pivot gear frictionally coupled to the rocker arm, the rocker arm and pivot gear being pivotably mounted along a common axis so that rotation of the pivot gear will tilt the rocker arm when movement of the rocker arm is not impeded;

a first gear pivotably mounted on the first portion and deriving its movement from the pivot gear for engaging the main gear to rotate the main gear in a predetermined direction;

a second gear pivotably mounted on the second portion and deriving its movement from the pivot gear for engaging the main gear to rotate the main gear in the predetermined direction;

wherein the angular disposition of the first and second portions allows only one of the first gear and the second gear to engage the main gear at any one time depending on the direction of rotation of the pivot gear and wherein the toothless sections are disposed such that when one of the toothless sections is rotated to be adjacent to the first gear, the second gear is adjacent to a toothed section of the main gear.

12. The apparatus according to claim 11, further including:

a cantilever spring having a free end; and two profiled ribs fixedly attached to the combination of the two cams and the main gear, each profiled rib corresponding to a toothless section and having two seats, each profiled rib interacting with the cantilever spring to bias the two cams to positions defined by the location of the free end of the cantilever spring in the seats.

13. The apparatus according to claim 11, further including a latching means for releasably engaging the rocker arm, wherein the latching means engages the rocker arm to prevent the rocker arm from tilting and disengages the rocker arm to allow the rocker arm to tilt to operate the two cams.

14. Apparatus for adjusting pen-to-print medium spacing in a printer comprising:

a fixed datum;

a print platen for supporting a print medium for printing by a pen moveable across the print medium, the print platen being resiliently biased towards the datum to come to rest directly against the datum to define a first spacing between the pen and the print platen, the print platen being moveable away from the datum to define a gap therebetween;

an arm movable into the gap for the print platen to alternatively rest against to thereby define a second spacing;

a rotatable first cam having a contour on which the arm rides for the arm to be moved; and a second cam fixed to the first cam, the second cam having a contour for engaging the print platen to move the print platen away from the datum to allow the arm to be moved into and out of the gap.

* * * * *